United States Patent [19]

Smith

[11] 4,017,346

[45] Apr. 12, 1977

[54] INSULATION OF VESSELS HAVING CURVED SURFACES

[75] Inventor: Hubert Stacy Smith, Bay City, Mich.

[73] Assignee: The Dow Chemical Company, Midland, Mich.

[22] Filed: May 28, 1974

[21] Appl. No.: 473,985

Related U.S. Application Data

[60] Division of Ser. No. 242,061, April 7, 1972, abandoned, which is a continuation-in-part of Ser. No. 158,272, June 30, 1971.

[52] U.S. Cl. ..... 156/185; 156/186; 156/195; 156/289; 156/290; 156/425

[51] Int. Cl.[2] ..... B65H 81/00

[58] Field of Search ..... 156/79, 71, 184, 185–186, 156/190–191, 195, 425, 289; 52/80, 573; 264/46.2, 46.6; 425/508, 506

[56] References Cited

UNITED STATES PATENTS

| | | | |
|---|---|---|---|
| 2,697,675 | 12/1954 | Gaiser | 156/289 X |
| 3,206,899 | 9/1965 | Wright | 52/80 |
| 3,365,855 | 1/1968 | Vermette | 52/80 X |
| 3,443,276 | 5/1969 | Smith et al. | 264/46.2 X |
| 3,548,453 | 12/1970 | Garis | 425/508 X |
| 3,590,448 | 7/1971 | Bryant | 52/80 UX |
| 3,773,600 | 11/1973 | Rudnev | 156/324 X |

*Primary Examiner*—David A. Simmons
*Attorney, Agent, or Firm*—Robert B. Ingraham

[57] ABSTRACT

Large vessels such as tanks and the like are insulated by means of a spiral generation process thereby providing rapid application of the insulation with minimal labor. The process is particularly suited for operation in confined quarters.

24 Claims, 32 Drawing Figures

Fig. 4
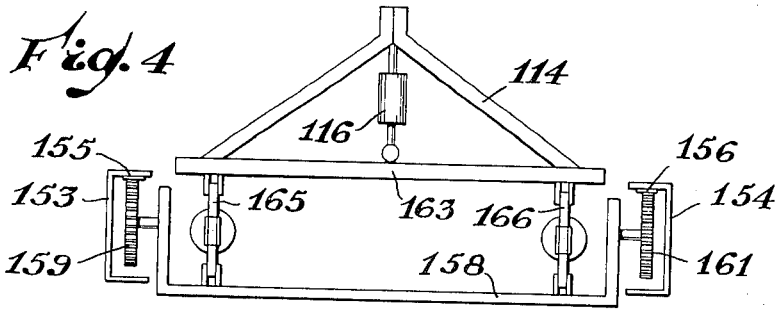
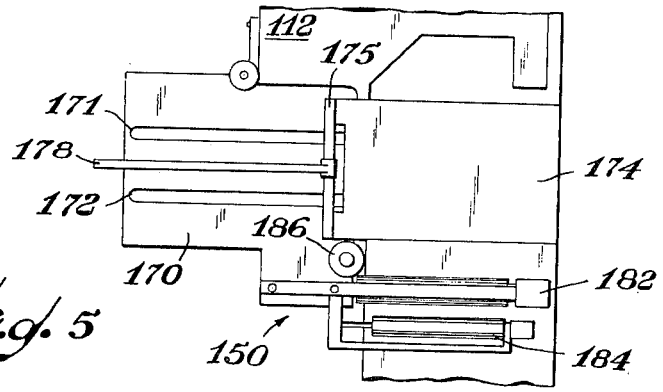
Fig. 5
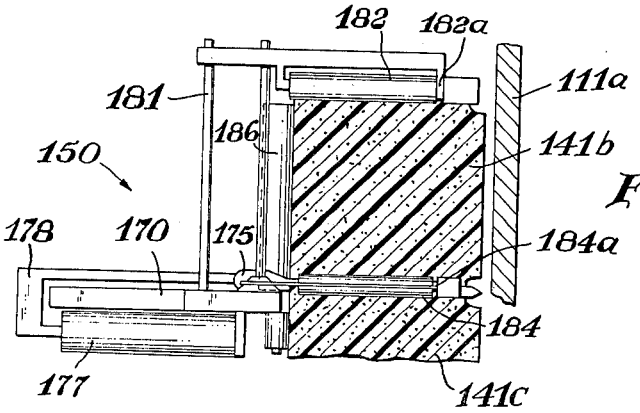
Fig. 6

INSULATION OF VESSELS HAVING CURVED SURFACES

This application is a divisional application of application Ser. No. 242,061, filed Apr. 7, 1972 now abandoned which is a continuation-in-part application of my co-pending application Ser. No. 158,272, filed June 30, 1971.

Vessels for the transportation of cryogenic materials must be insulated to a relatively high degree. The installation of such insulation often presents substantial problems. A reliably insulated vessel which may be shipped, transported and the like frequently requires a first inner vessel to contain the cryogenic fluid. Oftentimes the inner vessel is surrounded by a second vessel adapted to entrap any leakage from the inner vessel and provide additional mechanical protection to the inner vessel. The second vessel in turn is enclosed within a third vessel oftentimes of substantial construction, and various insulating materials are disposed between the first and second vessels. Oftentimes cryogenic vessels are constructed in a generally curved configuration such as a sphere in order to present a minimal heat transfer surface relative to the contained volume. Desirably, such curved surfaces are also of particular benefit when it is desired to make a relatively light weight vessel which will withstand internal pressure. Such vessels with curved surfaces include spherical vessels such as tanks, cylindrical vessels having dished heads, the heads being dished either convex out or concave out, prolate spheroids and oblate spheroids, ellipsoids and the like. However, one of the more commonly used vessels or containers is the spherical tank. Spherical tanks or containers offer some geometric advantages for the containment of cryogenic materials particularly in large sizes. The geometry of a sphere provides substantial economy in layout and maintaining desired dimensions during construction. An equatorially mounted sphere offers substantial advantage in use as a cryogenic vessel particularly when the equatorially mounted sphere is supported by a generally cylindrical support having a diameter approximating the diameter of the sphere. The dimensional changes which occur in a structure when the temperature is reduced from ambient to the desired temperature of the cryogenic material oftentimes are substantial; for example, in a container for liquefied natural gas which at atmospheric pressure boils at a temperature generally in the range of about −260° F. Once having solved the mechanical problems associated with the dimensional change of the spherical tank for such cryogenic material, the problems connected with dimensional changes and stress occurring in the insulation associated with the vessel offer substantial difficulty. Oftentimes such vessels are insulated by the application of preformed foam bodies in the form of panels which are subsequently joined to prevent thermal leakage and are overcoated with a vapor barrier layer to prevent the entry of water or water vapor into any region of the insulation having a temperature below 32° F. The vapor barrier avoids the loss of insulating properties by the formation of ice, frost or other forms of solidified water in the insulation. The insulation may be foamed in place adjacent the tank employing liquid resins or self-reacting foam-forming chemical components. Frequently, either approach is laborious and oftentimes requires substantial working space about the surface of the tank to be insulated. Frequently such insulation is severely strained and ruptures when the vessel is cooled to its desired operating temperature, and due to the general requirement of a surrounding vapor barrier, repairs are extremely difficult.

It would be desirable if there were an improved method available for the insulation of cryogenic vessels.

It would also be desirable if there were an improved method for the insulation of cryogenic vessels which required minimal working space exterior to the vessel.

It would also be desirable if there were available an improved method for insulating cryogenic vessels which minimized stress cracking failure in the insulation under operating conditions.

It would further be desirable if there were available an improved method for insulating cryogenic vessels and applying a vapor barrier to the external surface thereof.

It would also be desirable if there were available an improved insulated cryogenic vessel.

It would also be desirable if there were available an improved method for the insulation of cryogenic vessels utilizing synthetic resinous foams.

It would further be desirable if there were available a method and apparatus for the preparation of reinforced insulation about a cryogenic vessel.

These benefits and other advantages in accordance with the present invention are achieved in a method for the insulation of vessels wherein a thermally insulating material is deposited about the periphery of the vessel in the form of a plurality of closed loops to thereby envelop at least a portion of the vessel within an insulating enclosure.

Also contemplated within the scope of the present invention is insulation-applying apparatus comprising in cooperative combination a first support means, a means to propel the first support means about the periphery of an object to be insulated, an insulation depositing means supported by the first support means and selectively moveable relative to the first support means, the depositing means adapted to trace a generally spiral path over an object to be insulated.

Also contemplated within the scope of the present invention is an improved insulated cryogenic vessel, the cryogenic vessel comprising at least a first containment vessel having an exterior curved surface, a layer of insulation disposed adjacent the exterior surfaces and covering at least a substantial portion thereof, the insulation being in the form of a plurality of loops or turns of a strip-like configuration, adjacent turns of the insulation being adhered to each other.

The term "spiral generation" refers to the preparation of structures by the progressive deposition of a foam or other building material by a material depositing means which travels about a predetermined path to deposit successive loops or turns, the progressive loops being adhered to adjacent loops. The process of spiral generation is well known in the art and has been the subject of numerous patents among which are U.S. Pat. No. 3,458,609; 3,206,899; 3,336,631; 3,336,632; 3,423,791 and 3,443,276, the teachings of which are herewith incorporated by reference.

Further features and advantages of the present invention will become more apparent from the following specification taken in connection with the drawing wherein:

FIG. 1 schematically depicts the insulation of a spherical vessel in accordance with the present invention.

FIG. 4 is a schematic representation of a support suitable for partial positioning of the foam depositing head of FIGS. 1, 2 and 3.

FIGS. 5, 6 and 7 are schematic representations of foam welding or joining assemblies employed with the depositing head of FIGS. 2 and 3.

Figure 10:
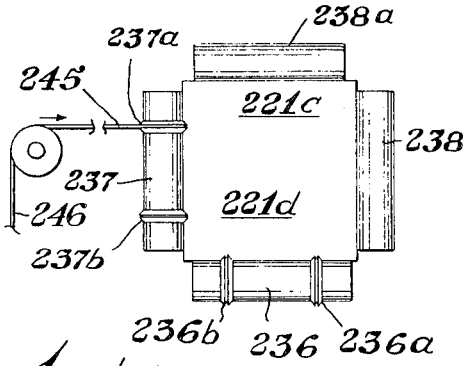
Figure 11:
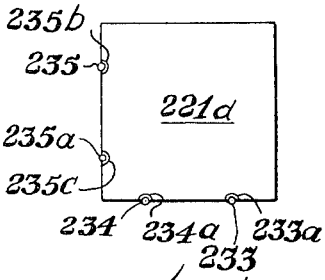
Figure 8:
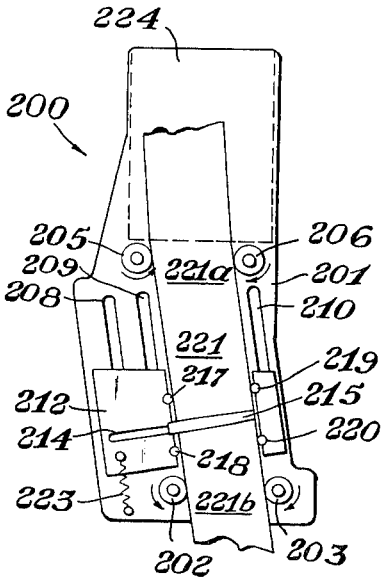
FIG. 8 is a schematic representation of a foam welding or joining device employed when a preformed foamed strip is utilized in the invention.
Figure 9:
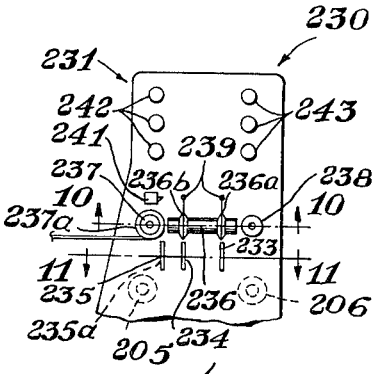

FIGS. 9, 10 and 11 schematically depict a reinforcing applicator adapted to act in cooperative combination with the apparatus of FIG. 8 to provide a reinforced preformed foam strip.

Figure 12:
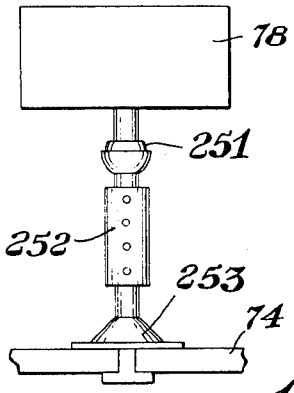
Figure 13:
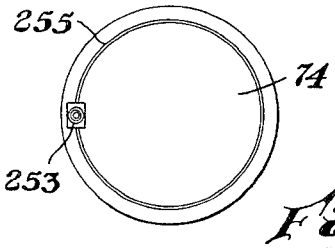

FIGS. 12 and 13 are schematic representations of the mounting and positioning of the welding and reinforcing apparatus of FIGS. 8 through 11.

Figure 1:
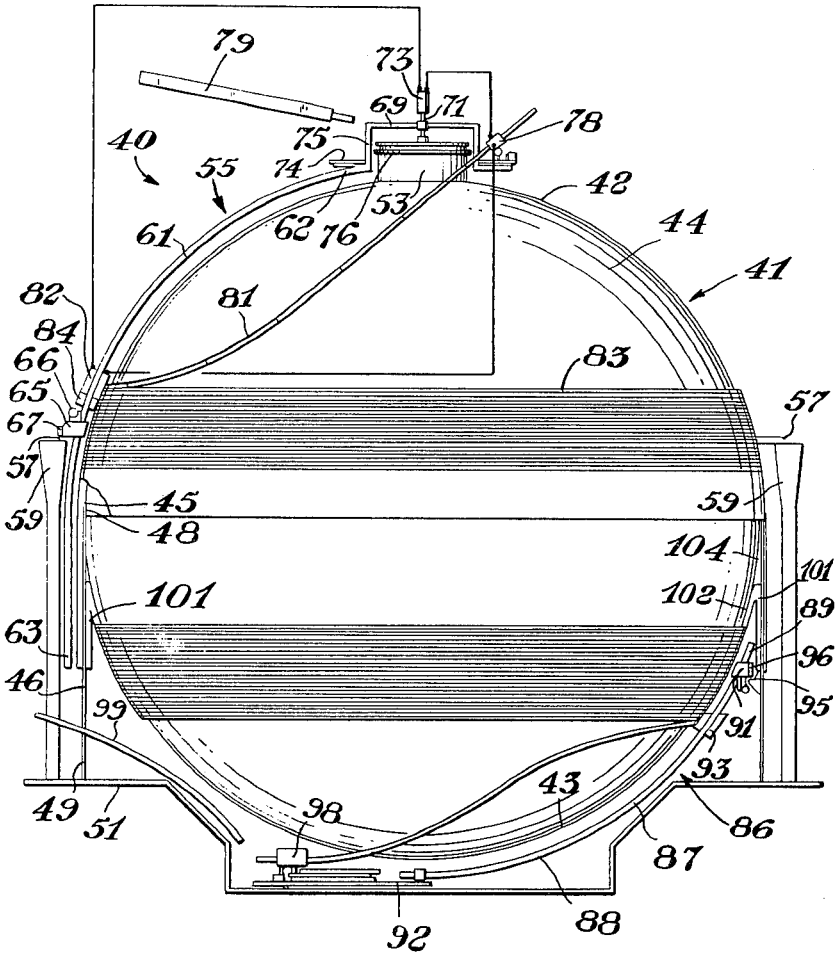
Figure 14:
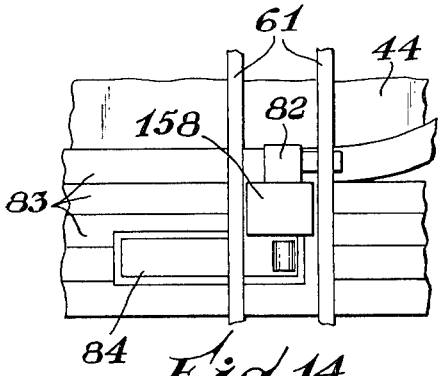

FIG. 14 shows a schematic fractional view of the structure of FIG. 1 in combination with a vapor barrier applying mechanism.

Figure 15:
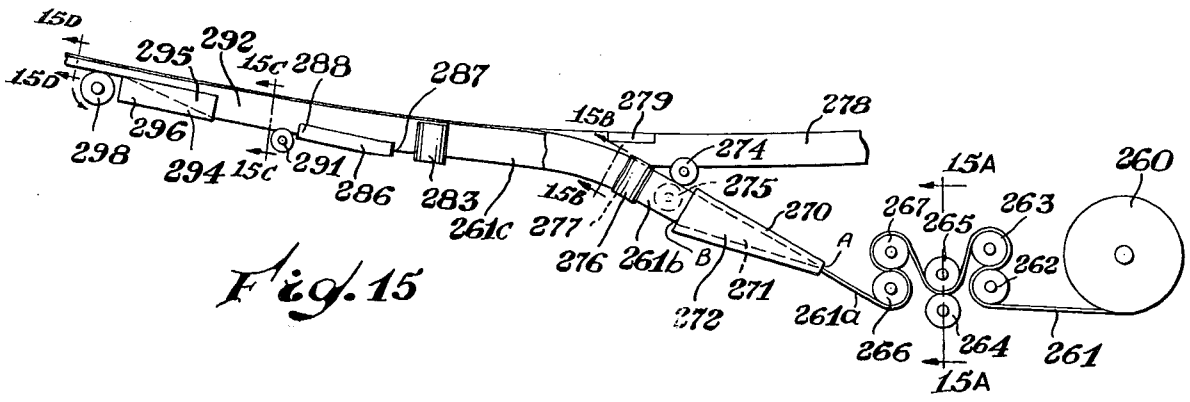
Figure 16:
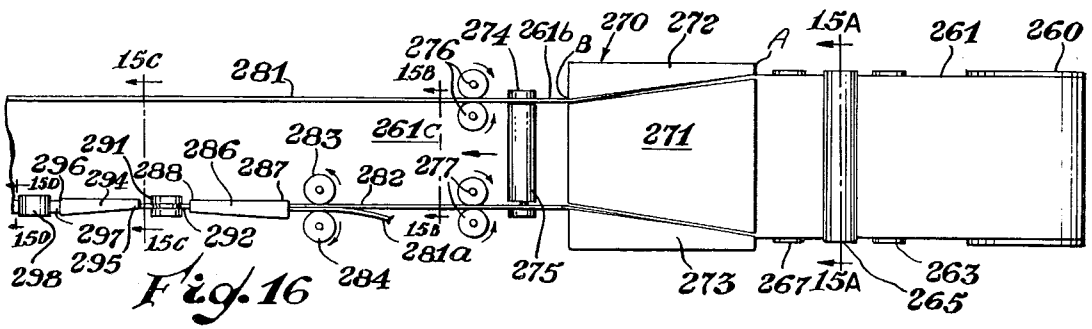

FIGS. 15 and 16 schematically depict the operation of the vapor barrier applying apparatus.

Figure 15A:
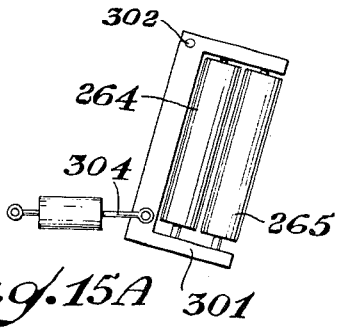

FIG. 15A is a schematic view of a portion of the apparatus of FIG. 14 along the line A—A of FIG. 15.

Figure 15B:
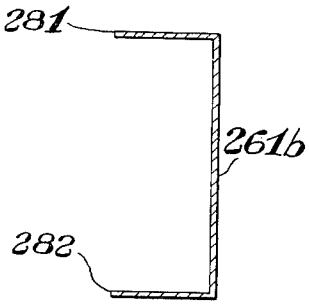
Figure 15C:
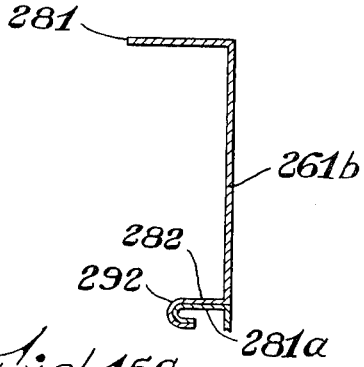
Figure 15D:
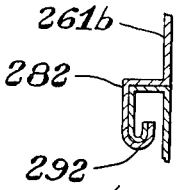

FIGS. 15B, 15C and 15D schematically depict the vapor barrier at various stages of formation.

Figure 17A:
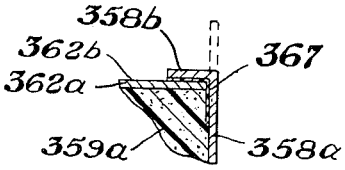
Figure 17B:
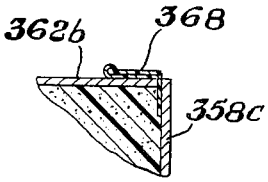
Figure 18:
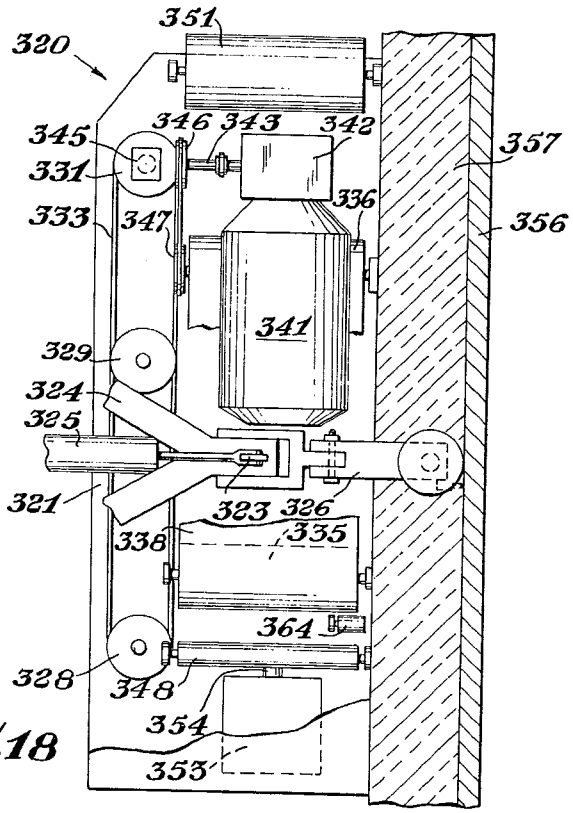
Figure 17:
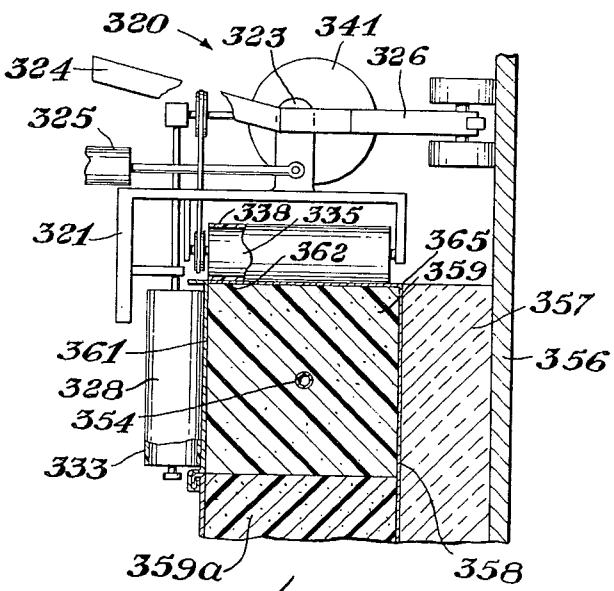

FIGS. 17 and 18 are two schematic views of an alternate foaming head useful with the apparatus of FIG. 1.

FIGS. 17A and 17B schematically depict different modes of installation of reinforcing material.

Figure 19:
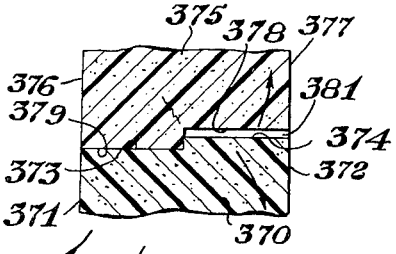

FIG. 19 is a schematic sectional view of one embodiment of a joint between adjacent turns employing preformed foam insulation.

Figure 20:
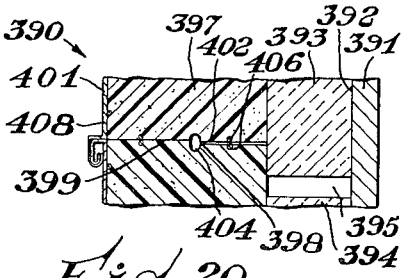

FIG. 20 is a schematic fragmentary sectional view of insulation applied employing preformed foam.

Figure 21:
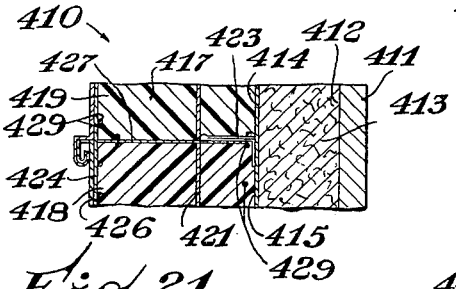

FIG. 21 is a schematic fractional sectional view of insulation applied employing foam-in-place material.

Figure 23:
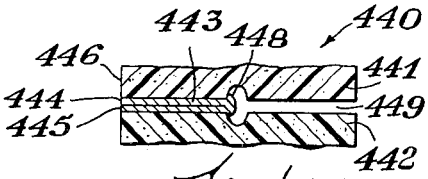
Figure 24:
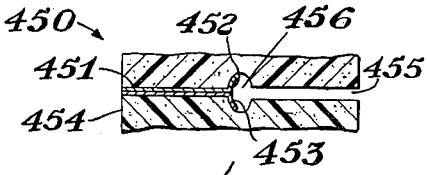

FIGS. 23, 23 and 24 schematically depict cross-sectional representations of alternate joints between adjacent stips applied in accordance with the present invention.

Figure 25:
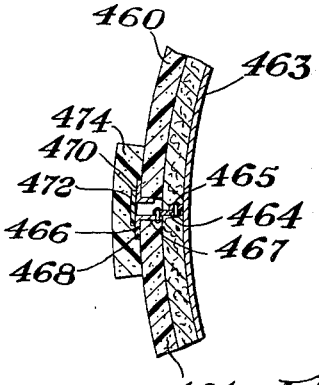

FIG. 25 schematically depicts a joint between insulation formed adjacent the vessel of FIG. 1 and insulation formed remote therefrom.

Figure 26:
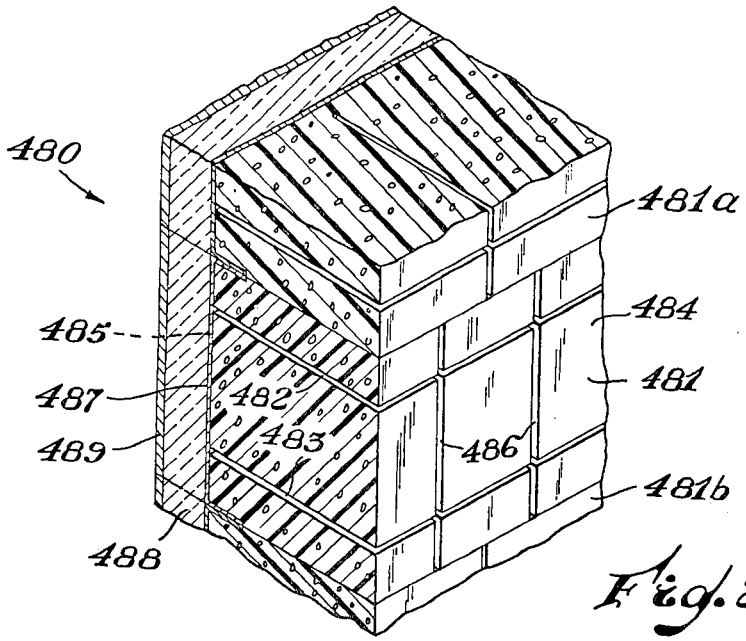
Figure 27:
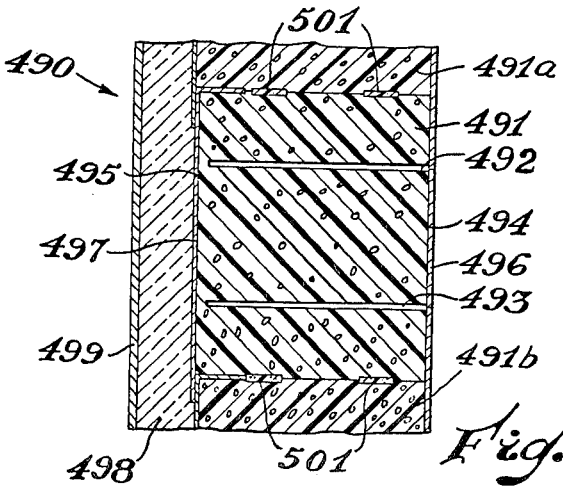

FIGS. 26 and 27 schematically depict alternate embodiments of insulation layers of the present invention.

In FIG. 1 there is schematically depicted a vessel assembly and insulation installing apparatus generally designated by the reference numeral 40. The assembly 40 comprises a generally spherical tank 41 defining an internal space, not shown, for the containment of cryogenic materials. The tank 41 has an upper or top portion 42 and a lower or bottom portion 43. The tank 41 has a generally spherical exterior doubly or compound curved surface 44. Generally intermediate the top 42 and bottom 43 is a diamstral or generally equatorial flange 45 extending about the tank 41. A support 46 of generally cylindrical configuration is disposed about the tank 41. The support 46 has an upper or top end 48 and a lower or bottom end 49 disposed about the tank 41. The upper end 48 of the cylindrical support 46 is in operative engagement with the flange 45. The second end 49 of the support 46 is affixed to a base or deck 51 of a vessel or other supporting means, not shown. The tank 41 has adjacent the top thereof a protective enclosure 53 adapted to enclosure 53 adapted to enclose fluid passageways, valves and the like, not shown. A first or upper insulating apparatus 55 is disposed generally adjacent the top 42 of the tank 41. The insulating apparatus comprises in cooperative combination a guide means 57, desirably a rail, which is maintained in fixed relationship to the tank 41 by means of a plurality of generally peripherally disposed supports 59. The supports 59 are affixed to the base 51. A generally arcuate support frame 61 extends from a location generally adjacent the top 42 of the tank 41 to a location between the flange 45 and bottom 43 of the tank 41. The arcuate support frame has an upper end 62 and a lower end 63. A frame drive means 65 is affixed to the frame 61 at a location generally adjacent the guide means or rail 57. The drive means 65 has a motor 66 which is operatively connected to a wheel or gear 67 in driving contact with the rail 57. Adjacent the first end of the frame 62 and in operative combination therewith is a pivot assembly 69. The pivot assembly 69 comprises a stub or pivot shaft 71 affixed to the enclosure 53 and lying on an axis of generation of the sphere and in general, equidistant from any location on the circular rail 57. The shaft 71 passes through the pivot assembly 69 and has disposed thereon a swivel joint assembly 73 remote from the enclosure 53. The assembly 73 provides rotary connections for a power source to supply electric, hydraulic and/or pneumatic power. The pivot assembly 69 has a peripheral platform 74 and a ring guide bearing 75 which engages a flange 76 on the enclosure 53 preventing axial wobble of the frame 69. An insulation source 78 is moveably positioned on the platform 74. A material source 79 is disposed adjacent the assembly 69; a supply 81 extends from the source 78 to a location adjacent the frame 61 which carries an insulation depositing head 82 adapted to receive foam or foamable material from the foam supply 81 and deposit it as a continuous strip on an adjacent strip. The foam depositing head 82 which deposits external insulation 83 has in operative association therewith a vapor barrier depositing means 84 which is adapted to move in fixed spaced relationship thereto. Generally adjacent the bottom 43 of the tank 41 is disposed a second or lower insulating apparatus generally designated by the reference numeral 86. The apparatus 86 comprises an arcuate frame 87 having a first end 88 and a second end 89, a frame driving assembly 91 affixed to the second end 89 and a frame pivot assembly 92 pivoted at a location generally coaxial with the pivot 71. The frame 87 has moveably disposed thereon a foam depositing head 93. A lower peripheral guide means or rail 95 is internally disposed within the cylindrical support 46 and is operatively combined with a wheel 96 supported on and driven by the drive means 91. The pivot assembly 92 has adjustably mounted thereon a second foam source 98. A material supply means 99 provides a source of material through the cylindrical support 46.

Generally in operation of the apparatus as depicted in FIG. 1, the upper portion of the vessel and a portion of the cylindrical support are insulated by first positioning the depositing head 82 adjacent the lower end 63 of the frame 61. The insulation, such as synthetic resinous foam, from the foam source is fed to the depositing head and a continuous strip of foam is deposited about the periphery of the support 46. The initial strip of insulation can be maintained in position by any desired means — adhesives, brackets affixed to the tank support and the like. Once the initial or first turn of foam is deposited, successive turns or loops of foam are applied and joined to the previously deposited turn. As the frame 61 rotates about the tank 49 applying successive strips, the depositing head 82 is moved upwardly from the lower end 63 of the frame 61 toward the upper end 62, thereby applying desired insulating material in a uniform manner and at a desired rate. The apparatus and process require little attention other than providing a supply of material for the foam insulating strip.

The lower insulation-applying apparatus operates in a generally similar manner wherein an insulating strip is applied to the tank 41 at a location generally adjacent the second end 89 of the frame 81 by the depositing head 93 and the strip, in effect, wound downwardly away from the equatorial flange of the tank to cover substantially a major portion of the lower surface. A generally cylindrical insulating member 101 is disposed on the inner surface of the cylindrical support 46 and the gap between the insulating member 101 and the spirally deposited insulation filled with insulating material 102 which may be in the form of preformed panels such as plastic foam panels or foamed-in-place plastic foam prepared from foamable, hardenable materials. Thus, a lower equatorial region 104 of the tank 41 does not receive any direct application of insulating material. However, the thermal path for heat entry to the tank 41 must come from a substantial distance through the support member 46 which has disposed thereon the external insulation 83 and the internal insulation 101.

Figure 3:
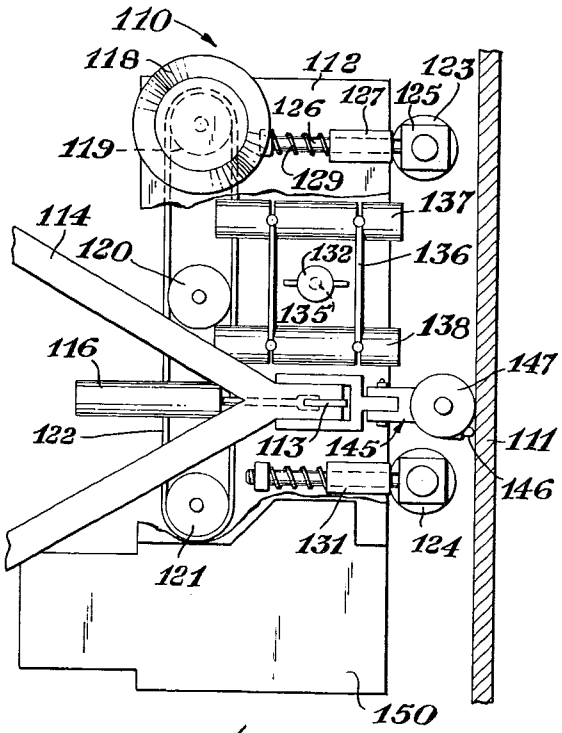
FIGS. 2 and 3 are schematic representations of portions of a foam depositing head useful in apparatus in accordance with FIG. 1.
Figure 2:
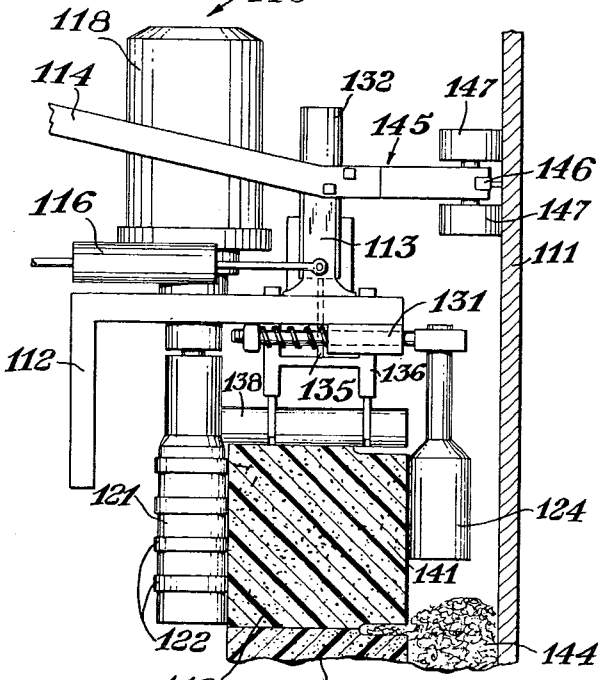

In FIGS. 2 and 3 there is depicted a front and top view of an insulation depositing head with welding assembly removed. The apparatus of FIGS. 2 and 3 is generally designated by the reference numeral 110 and is particularly suited for the deposition of preformed insulation strips of foamed thermoplastic resin or strips having thermoplastic surfaces which may be heat bonded together. The apparatus 110 is depicted in engagement with a tank or vessel wall 111. The apparatus 110 comprises in cooperative combination a frame or support means 112 having a generally L-shaped configuration. The frame 112 has disposed thereon an extending support 113. The support 113 is in operative engagement with a support arm 114 which in turn is supported by a carriage on an arcuate support such as the support frames 61 and 87 of FIG. 1. The support 113 is pivotally affixed to the arm 114. The support 113 at a location between the arm 114 and the frame 112 has pivotally attached thereto a lateral positioning means or fluid operated cylinder 116 which extends between the arm 113 and the arcuate frame carriage. The fluid operated cylinder positions the support 113 in angular relationship with the support arm 114 and therefore the frame 112 relative to the wall 111. The frame 112 supports a drive motor 118 which is in operative communication with a first drive roll 119. Beneficially, the motor 118 is a gear head electric, hydraulic or pneumatic motor. A second drive roll 120 and a third drive roll 121 are pivotally mounted on the frame 112. A plurality of belts 122 beneficially of V-type configuration engage appropriate grooves in the rolls 119, 120 and 121 providing a high friction surface. The axes of the drive rolls 119, 120 and 121 are generally coplanar and lie in a plane generally parallel to the wall 111. The drive rolls 119, 120 and 121 depend from the frame 112 remote from the support 113. A first side guide roll 123 is disposed generally opposite the first drive roll 119. A second guide roll 124 is oppositely disposed to the drive roll 121. The axes of rolls 119 and 123 are generally coplanar as are the axes of rolls 121 and 124. The roll 123 is rotatably mounted in a pivot 125. The pivot 125 is supported by a shaft 126 carried in a bearing 127 affixed to the frame 112. A tensioning means or spring 129 serves to tension the bearing 125 and the roll 123 toward the drive roll 119. The roll 124 is mounted in a similar assembly designated by the reference numeral 131 which tensions the roll 124 toward the drive roll 121. The rolls 123 and 124 are free to rotate about the axis of generation and to move away from or toward the adjacent drive roll but their axes of rotation are maintained generally parallel to the axis of rotation of the associated drive roll. A roll positioner 132 is affixed to the frame 112. The roll positioner beneficially is a fluid actuated cylinder having an extensible rod or arm 135; the rod 135 is in operative engagement with a pressure roll frame 136 which in turn carries, two pressure rolls 137 and 138 pivotally supported therein. The pressure rolls 137 and 138 have axes of rotation which lie in a plane generally normal to a plane containing the axes of rolls 119, 120 and 121 and normal to a plane containing the axes of rolls 123 and 124. Thus, the three sets of rolls form a channel wherein the drive rolls 119, 120 and 121 form one side of the channel, the rolls 122, 123 and 124 define the opposite side, and the rolls 137 and 138 form the top of the channel generally designated by the reference numeral 141. In FIG. 2 a first foam element 142 is disposed within the channel 141. The foam element 142 is disposed within the channel 141. The foam element 142 is generally contiguous with a foam element **142*a* and a fibrous insulating batt 144 is disposed between the elements 142*a* and the tank wall 111. A guide roll assembly 145 is affixed to the arm 114 and is optionally employed to space the depositing assembly 110 from the wall 111. A limit sensor 146, such as a single pole double throw electric switch, pneumatic pilot valve or the like, is supported on the assembly 145 and is connected by means, not shown, to control the positioning of the depositing head 110. Thus, when rolls 147 of the guide roll assembly 145 no longer contact the wall 111 for a predetermined distance, a suitable correction is made. A welding assembly 150 is schematically depicted in FIG. 3 affixed to the frame 112**.

FIG. 4 schematically depicts the relationship between the arms 114 and the positioner 116 and a carriage moveable along the arcuate frame. Reference numerals 153 and 154 depict side members of an arcuate frame similar to the arcuate frames 61 and 87 of FIG. 1. The frame member 153 has disposed therein a first rack 155 while the member 154 has disposed therein a second similar rack 156. A frame carriage 158 is disposed between the frame members 154 and 153. The frame supports a first gear 159 and a second gear 161. The gears 159 and 161 engage racks 155 and 156, respectively. The gears 159 and 161 are driven at equal rates by a motor, not shown. The frame 158 carries an adjustably mounted base 163. The base 163 is connected to the frame 158 and first and second adjustable length supports 165 and 166, respectively. The adjustable length supports may be of any desired construction, but beneficially may have the configuration of the conventional scissors jack and are driven by a motor, not shown, actuated by the limit sensor 146 depicted in FIGS. 2 and 3.

Figure 7:
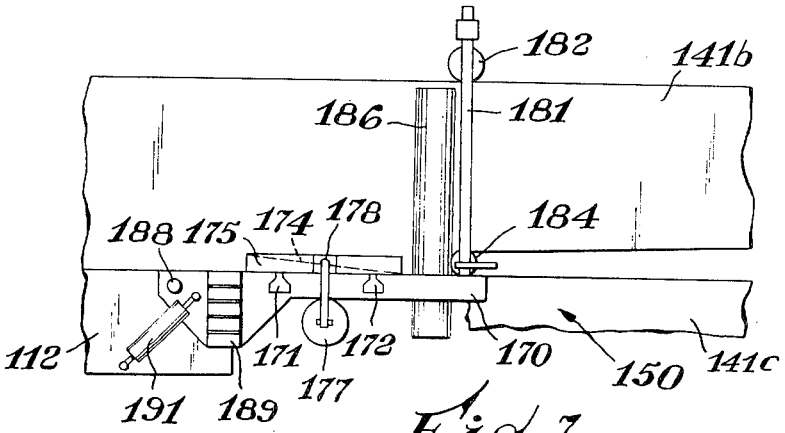

FIGS. 5, 6 and 7 schematically depict three views of the welding or joining head schematically depicted in FIG. 3 by the reference numeral 150. The head 150 comprises in cooperative combination a frame 170. The frame 170 defines therein first and second ways 171 and 172. A generally wedge-shaped heating platen 174 is affixed to a carriage 175 slidably mounted on the ways 171 and 172. A linear positioner 177, such as a pneumatic or hydraulic cylinder, is rigidly affixed to the frame 170 and to an arm or connecting means 178. The arm 178 is of generally U-shaped configuration (for mechanical convenience) and is adapted to move the carriage 175 to one of the two extreme positions permitted by the ways 171 and 172. Affixed to the frame 170 is a first or vertical support 181. The support 181 carries a top pressure roll 182 adapted to engage an upper portion of a form member 141*b*. By "upper portion of the foam member" is meant the portion remote from the last deposited strip and remote from the heating platen. The support 181 or frame 170 carries a second or separation roll 184 adapted to maintain a desired distance between a previously deposited foam strip such as the foam strip 141*c* and the foam strip 141*b* about to be deposited. The roll or separator 184 is generally parallel to the roll 182. As depicted in FIGS. 5 and 6, rolls 182 and 184 have bearing means 182*a* and 184*a* which, in effect, divide the roll into two portions and allow the roll surface to contact the foam strip 141*b* without interference from an outboard bearing which, in certain instances, might interfere with a wall such as the wall 11*a* depicted in FIG. 6. An edge guide roll 186 is pivotally supported within the frame 170 and is adapted to extend on either side of the plane of the heating platen and provide positive guidance of the frame from an already deposited strip such as the strip 141*c* of FIG. 6. Beneficially, the frame 170 is pivotally attached to the frame 112 by a first pivot 188. The pivot 188 permits rotation about an axis lying in a plane generally parallel to the plane of the heating means or platen. The pivot 188 in turn carries what may be referred to as a horizontal or second pivot 189 which permits motion of the frame 170 within the plane parallel to the plane of the heating platen and about an axis normal to the plane of the heating platen. A linear positioning device 191 such as a hydraulic cylinder employing a suitable source of fluid under pressure beneficially can serve to position the frame 170 relative to the frame 112.

In FIG. 8 there is schematically depicted one embodiment of the foam source 78 of FIG. 1 generally designated by the reference numeral 200. The source 200 is a welding or joining mechanism particularly suited for use with preformed foam plastic billets or strips and is adapted to join or butt weld the strips in end to end relationship. The welding assembly 200 comprises in cooperative combination a frame 201 which has rotatably supported thereon first and second input drive rolls 202 and 203. The drive rolls 202 and 203 are driven by a suitable motor, not shown. A second or output pair of drive rolls 205 and 206 are remotely disposed on the frame 201 and are separately driven by an appropriate drive means, not shown. The first and second pairs of drive rolls have generally parallel axes and are disposed on one side of the frame 201. Beneficially, each pair of rolls; that is, the rolls 202 and 203, are resiliently tensioned toward each other, as are the rolls 205 and 206, and adapted to receive between them a strip of preformed plastic foam of the appropriate size. The frame 201 defines ways or slots 208, 209 and 210. The ways 208, 209 and 210 are parallel to each other and slidably receive a carriage 212. The carriage 212 is freely slidably positionable between the input rolls 202 and 203 and the output rolls 205 and 206. The carriage 212 has defined therein a way or slide 214 which extends in the direction generally perpendicular to the major dimension of the ways 208, 209 and 210. A heating platen 215 is slidably mounted within the way 214. A first pair of carriage guide rolls 217 and 218, having axes generally parallel to each other and also to the axis of the roll 202, are disposed generally adjacent the rolls 202 and 205. A second pair of carriage guide rolls 219 and 220 are rotatably affixed to the carriage 212 and are oppositely disposed to the rolls 217 and 218. The axes of the rolls 219 and 220 are generally parallel to the axes of the rolls 217 and 218. In effect, the rolls 203, 219, 220 and 206 form one side of a foam passage 221. The second generally parallel and opposite side is formed by the rolls 202, 217, 218 and 205. The remaining side of the passage or channel 221 is formed by the frame 201. Disposed within the channel 221 is shown a first foam strip 221*a* and a second foam strip 221*b*, the ends of which abut the platen 215. The platen 215 is in operative combination with a suitable positioning means such as a linear actuator, air of hydraulic cylinder which permits the platen to be placed at least partially within the channel 221 or to be withdrawn entirely from the channel 221. For ease of illustration and clarity, the positioner is not illustrated. A resilient tensioning means 223 such as a spring is operatively connected to the carriage 212 and to the frame 201 in such a manner as to urge the carriage 212 toward the feed or input rolls 202 and 203. The frame 201 has an accessory area 224 remotely disposed from the input rolls 202 and 203 and generally adjacent the output rolls 205 and 206 and is adapted to receive material therefrom.

In operation of the apparatus 200, a foam strip, such as the strip 221*a*, is fed to the input rolls 202 and 203. The strip is passed through the channel 221 with the platen 215 retracted just before the end of the strip passes the platen 215. The end of the strip 221*b* is inserted between the rolls 202 and 203 and forced to a location between the guide rolls 218 and 220. The platen 215 is interposed between the strip ends and the strip ends forced into contact with the platen by applying pressure to the strip 221*b* either manually or by means of the rolls 202 and 203. The carriage 212, by means of its resilient mounting, permits the platen to be essentially self-centering between the ends of adjacent strips. When the ends of the thermoplastic foam have been heated to a desired extent to permit adhesion to each other, the platen 215 is rapidly withdrawn and the heat softened ends placed in abutting relationship. Loss of heat from the region causes solidification of the thermoplastic material between the foam strips and effectively welds them together. Beneficially, the weld is accomplished in such a manner as to provide minor misalignment of the axes of the two strips, the misalignment approximating the curvature of the surface being covered by the foam. Such misalignment usually can be readily obtained manually or by adjustment of the guide rolls 217 and 218. By providing such minor misalignment, a stress concentration at the weld point is avoided when the strip is wrapped around a curved surface such as that depicted with the foam supply 81 of FIG. 1.

In FIG. 9 there is schematically depicted an optional and desirable reinforcing apparatus generally designated by the reference numeral 230 adapted to be employed in the location 224 of the apparatus 200 of FIG. 8. The apparatus 230 comprises in cooperative combination a frame 231 which may be integral with or optionally, detachable from, the frame 201 of the apparatus 200. In order to facilitate locating the apparatus 230, the rolls 205 and 206 are shown in dotted lines. The frame 231 has supported thereon a plurality of heating elements designated by the reference numerals 233, 234, 235 and 235*b*. The heating elements 233, 234, 235 and 235*b* are generally linear elongate elements. The elements 233 and 234 are disposed generally adjacent the surface of the frame 231, while the elements 235 and 235*b* are in vertical spaced relationship from the base and in locations generally corresponding to the bottom and one side of the channel 221 of the apparatus 220. Generally adjacent the heating elements 233 and 234 is a first implanting or applicator roll 236 rotatably supported on the frame 231. A second applicator roll 237 is disposed adjacent the heating elements 235 and 235*b*. The roll 236 has grooved protuberances 236*a* and 236*b* which are disposed adjacent the heating elements 233 and 234. The roll 237 has a similar pair of protuberances each disposed adjacent the heating elements 235 and 235*b*. One of such protuberances 237*a* is shown. A guide roll 238 is in operative association with the rolls 236 and 237 to force a foam strip onto the roll 237. A similar guide roll is in association with the roll 236, but has been omitted from the illustration. Generally adjacent the rolls 236 and 237 are cooling means, conveniently air jets, 239 adjacent the roll 236 and jets 241 adjacent the roll 237. Generally adjacent the air jets and remote from the rolls 236 and 237 are two sets of guide rolls 242 and 243. The rolls 242 and 243 generally define a continuation of the channel 221 of FIG. 8 and have axes parallel to the rolls 205 and 206.

FIG. 10 schematically depicts the roll arrangement along a line 10—10 of the apparatus 230 of FIG. 9 showing the relative positioning of the rolls 236, 237 and 238, together with a fourth roll 238*a*, not shown in FIG. 9. The axes of the four rolls are generally coplanar and the rolls are arranged to form a passage 221*c* through which a foam strip such as the strip 221*d* is passed. An elongate reinforcing means 245 such as filament or yarn is depicted in operable engagement with the protuberances 237*a* of the roll 237. Reinforcing means 245 beneficially is supplied by a reinforcing filament source 246 such as a spool, drum or other convenient means. Similar reinforcing means are fed to grooved protuberances 237*b*, 236*a* and 236*b* from sources not shown.

Thus, a continuous foam strip coming from the apparatus 200 is heated at locations corresponding to the heaters 233, 234, 235 and 235*b*. The thermoplastic foam is melted or softened to a readily deformable state but to a temperature below that at which substantial decomposition takes place. Reinforcing fibers such as the fibers 245 are then pressed into the heat plastified foam surface by means of the protuberances 236*a*, 236*b*, 237*a* and 237*b* of the rolls 236 and 237, respectively. Generally, a thermoplastic foam suitable for an insulating layer under ambient temperatures is relatively rigid. Under such conditions the collapsed foam will harden and effectively entrap the filamentary reinforcing means therein. Such reinforcing will vary from glass fiber roving to a metal monofilament such as smooth fence wire, depending upon the needs of the particular structure being formed. Beneficially, such elongate reinforcing is applied to the portion of the strip which will form the outside of the structure and a portion of the strip which lies between adjacent strips. Thus, in the finished installation, the reinforcement applied by the protuberances 237*a* and 237*b* lies on the exterior surface of the installation such as the exterior surface of the insulation 83 of FIG. 1, and the fibers corresponding to the protuberances 236*a* and 236*b* are disposed on the lower surface of the foam supply or strip 81 of FIG. 1. Such reinforcing filaments are particularly beneficial when a relatively large foam strip is being bent over a curved surface, as on bending the exterior surfaces are subjected to significant tensile force. After construction of the insulation, the filamentary reinforcing is beneficial when the insulation is subjected to stresses generated by temperature differentials between the inner and outer surfaces of the insulation.

In FIG. 11 there is a schematic representation of the positioning of the heating elements 233, 234, 235 and 235*b* of the apparatus 230 of FIG. 9 relative to a foam section such as the section 221*d*. Corresponding portions of the foam 233*a*, 234*a*, 235*a* and 235*c* are shown collapsed or melted by the heat of the elements.

In FIG. 12 there is schematically depicted the mounting of a foam source such as the source 78 of FIG. 1 on the support 74. The foam source 78 beneficially comprises a combination of apparatus such as that depicted in FIGS. 4, 5, 6, 7, 8, 9, 10 and 11. The apparatus 78 conveniently is mounted in such a manner that it can be pivoted about a solid angle by means of a joint 251 such as a ball joint, a Cardan universal joint or any other of many well known joints of this nature. Conveniently, the joint 251 is supported on an adjustable height stand 252 which can be a hydraulic cylinder, a frame, rack and pinion or other obvious mechanical equivalents. The height adjusting means 252 is slidably supported within the support 74 in such a manner that it may be positioned about the periphery by the support means 253.

FIG. 13 schematically depicts a top view of the support means 74 of FIG. 1 showing a circular guide means or way 255 which receives and guides the support member 253 of FIG. 12. The welding or joining head 200 of FIG. 8, with or without the reinforcing arrangement as depicted in FIGS. 9, 10 and 11 and supported in the manner depicted in FIGS. 12 and 13, readily supplies a preformed foamed continuous strip to the depositing head 82 of FIG. 1 as a frame such as the arc support frame 61 rotates about the tank 41 and permits the spiral application of insulation to the tank to a location close to the top 42. The remaining portions of insulation may either be applied as foam-in-place, or alternately, prefabricated sections are readily installed.

In FIG. 14 there is depicted a fractional view of the apparatus of FIG. 1 illustrating the relative positioning of the arc frame support 61, the surface of the tank 44, the foam depositing head 82, insulation 83 of FIG. 1, the carriage 158 of FIG. 4 and the vapor barrier depositing means 84 of FIG. 1.

FIGS. 15 and 16 are two schematic views of the operation of the vapor barrier depositing means 84 of FIGS. 1 and 14 showing sequentially the elements which form a vapor barrier on the surface of the insulation 83 at a rate generally equal to the deposition of the foam insulation. In FIGS. 15 and 16 a source 260 provides a continuous strip of a thin malleable vapor barrier material such as a metal or plastic foil having an adhesive layer disposed thereon. A foil strip 261 is removed from the source 260 and is passed to forming rolls 262, 263, 264, 265, 266 and 267. The rolls are arranged in three pairs. Rolls 262 and 263 are the first pair; rolls 264 and 265 are the second pair, the rolls 266 and 267 are the third pair. The first and third pairs of rolls serve as restraining or friction rolls, while the rolls 264 and 265 are each mounted in a frame which is displaceable relative to the first and third pairs of rolls, thus permitting the malleable strip to be stretched adjacent one edge thereof and distort the ribbon from its planar or cylindrical form to a degree sufficient to permit it to conform to a doubly curved surface to which it is being applied. As depicted in FIG. 1, the amount of stretching required would be zero on the cylindrical skirt of the tank and would increase as the barrier applicator 84 approaches the top 42 of the tank 41. The suitably stretched or unstretched foil or film 261*a* is passed to a flange forming unit 270 which beneficially consists of a shoe 271 and a guide 272 into which the shoe is recessed. A space 273 is defined between the shoe 271 and the guide 272. The space varies in configuration from a flat slit at location A to a channel-shaped configuration at location B. The malleable strip 261*a* has then been formed into a channel-shaped configuration 261*b*. The channel-shaped configuration is then engaged by idler rolls 274 and 275 which engage the web of the channel and first and second flange engaging idler roll pairs 276 and 277. The rolls 274 and 275 and the roll pairs 276 and 277 serve to guide and position the channel-shaped strip 261*b* to a desired location remote from the forming shoe 271 and generally adjacent foam insulation 278. A heater 279 is disposed adjacent the foam insulation 278. The heater 279 serves to heat the foam insulation and a thermoplastic heat seal coating on the strip 261*b* which is disposed adjacent the foam. At a location indicated by the reference numeral 261*c*, the generally channel-shaped strip 261*b* is adhered to the foam insulation 278. The strip 261*b* has a first flange 281 and a second or lower flange 282. The flange 282 is placed in intimate contact with a flange 281*a* of the previously deposited vapor barrier strip and is engaged by heat sealing rolls 283 and 284, the heat seal rolls 283 and 284 effectively joining the thermoplastic coating on the flanges 282 and 281. A flange rolling shoe 286 is disposed adjacent the heat sealing rolls 283 and 284 and remote from the forming shoe, 271. The flange rolling shoe or means 286 has a first or inlet end 287 and a second or discharge end 288. The shoe 286 is a smoothly rounded channel of substantially larger curvature at the inlet end 287 than at the discharge end 288. Adjacent the discharge end 288 is disposed an idler roll 291 which engages a rolled edge 292 issuing from the forming means 286. A flange folding means or shoe 294 is disposed adjacent the roll 291 and remote from the forming means 286. The former 294 has an entrance end 295 and an exit end 296. The folding or forming means 294 serves to fold the double flange and rolled edge 292 to form a seam 297. Adjacent the discharge end 296 of the forming means 294 is a guide or idler roll 298 which serves to further position the barrier depositing means 84 in its desired location.

FIG. 15A is a schematic representation of the mounting of the rolls 264 and 265 when viewed along the lines A—A of FIG. 15. The rolls 264 and 265 are mounted in a generally parallel rotatable manner in a frame 301. The frame 301 is in operative engagement with a pivot or bearing 302, the bearing 302 being fixed to the depositing means 84. The linear actuator or positioner 302 is pivotally affixed to the frame 301 at a location remote from the pivot 302. Remote from the frame 301, the linear actuator 304 is also affixed to the frame 84.

Thus, the angle of the axes of the rolls 265 and 264 is readily varied from being parallel to the rolls 262, 263, 266 and 267 to a substantial deviation sufficient to stretch the strip 261 to a desired degree. For purposes of illustration, the strip 261 is shown as a flat or planar strip. However, desirably for many applications a corrugated strip is employed wherein the corrugations are minor and have a length of from about 10 to 50 times the thickness of the strip and a corrugation height approximating the thickness of the strip.

In FIG. 15B there is shown a sectional view of the strip 261*b* viewed along the line B—B of FIG. 15.

FIG. 15C is a sectional view of the strip 261*b* along the line C—C of FIG. 15 showing the flange configuration after being heat sealed to an adjacent similar strip and passing through the former 286.

FIG. 15D depicts the strip 261*b* and the flange 282 after forming by the forming means 294.

In FIGS. 17 and 18 there is depicted an alternate foam forming head generally designated by the reference numeral 320. The foam forming head 320 is particularly suited to the deposition of foam-in-place resinous compositions such as foam-in-place polyurethanes, epoxy resins, phenolic foams and the like. The head 320 comprises in cooperative combination a frame 321. The frame 321 has disposed on one side thereof a mounting and positioning means or trunnion 323. The positioning means 323 is pivotally affixed to a support arm 324 which is equivalent to the arm 114 of FIGS. 326 and 3. A linear actuator 325 is pivotally attached to the trunnion 323 and is fully equivalent to the positioner 116 of FIGS. 2 and 3. A positioning assembly 236 is affixed to the arm 324 and is the full equivalent of the assembly 145 of FIGS. 2 and 3. The frame 321 has rotatably supported thereon a set of side rolls 328, 329 and 331. The side rolls 328, 329 and 331 are in generally parallel spaced apart relationship with the axis generally co-linear. A side forming belt 333 passes about the rolls 328, 329 and 331. A second set of forming rolls 335 and 336 are rotatably supported on the frame 321. The rolls 335 and 336 are disposed generally at right angles to the rolls 328, 329 and 331 and have disposed thereon an upper or top forming belt 338. The belts 333 and 338 effectively form two sides of a channel. The drive rolls 331 and 336 are in operative combination with a drive motor 341 by means of a gear reducer 342. The output shaft 343 of the gear reducer 342 is in combination with a right angle drive or gear train 345 which drives the roll 331 and a motion transmission means or sprocket 346, which in turn drives a second sprocket 347 which is in operative engagement with the roll 336. Generally adjacent the roll 338 and remote from the roll 331 is a scrim idler or guide roll 348 adapted to receive a permeable scrim such as cloth or screen from a scrim supply spool 351 supported on the frame 321 generally adjacent the gear reducer 342. A mixing assembly 353 is disposed generally adjacent the guide roll 348 and the mixer 353 is adapted to receive appropriate foam materials for the preparation of foamable hardenable material, which in turn is discharged through a dispenser tube 354 which discharges foamable hardenable material at a location generally between the remote edges of the belts 333 and 338. The apparatus 320 is depicted in engagement with a tank wall 356 which has a layer of fibrous insulation 357 disposed thereon such as a glass fiber batt. A first inner scrim 358 is disposed between the insulation 357 and a hardened foam 359 discharged through the discharge conduit 354. A similar body of foam 359*a* is disposed immediately adjacent the body 359. Thus, the scrim 358 and the body 359, the belts 333 and 338 define a rectangular channel into which the foamable hardenable material is discharged. Advantageously, adjacent the belt 333 a vapor barrier member 361 is interposed between the belt and the foam 359, and on hardening and curing, the barrier is adhered to the foam body. Beneficially, a top scrim 362 is interposed between the belt 338 and the foam 359 which provides beneficial reinforcement in the insulation layer. The top scrim 362 is beneficially supplied from the scrim roll 351 shown in FIG. 18 and passes to the scrim idler 348 and then onto the surface of the belt 338. Advantageously disposed between the roll 335 and the roll 348 is a scrim edge folding means 364 adapted to receive the edge of the scrim such as the scrim 358 and fold it to a desired configuration.

FIG. 17A depicts a configuration which would be desirable at the location 365 as depicted in FIG. 17. FIG. 17A is an enlarged fractional view of a foam strip 359*a* having a top scrim 362*a* disposed thereon and a side scrim 358*a*. Generally adjacent the uppermost portion of the scrim 358*a* is a releaseable film strip 367 which is interposed between the upper surface 362*b* of the scrim 362*a* and a folded portion 358*b* of the scrim 358*a*. Beneficially, such a film is polyethylene, polytetrafluoroethylene, a hydrocarbon wax or like material which does not readily adhere to the scrim or to the foam.

An alternate arrangement is depicted in FIG. 17B showing an upper scrim 362*b*, a side scrim 358*c* and a film insert 368 lapping over the upper scrim 362*b* effectively preventing adjacent portions of the foam body from adhering in the region. Both the arrangements of FIGS. 17A and 17B provide stress relief when the surface of the foam insulation adjacent the tank wall 356 is reduced in temperature below the temperature of the outermost portion of the foam adjacent the vapor barrier 361.

FIG. 19 schematically depicts a mode of stress relief suitable for use with preformed foam strips. FIG. 19 shows a deposited preformed foam strip 370 having an outer surface 371, an inner surface 372 and an upper surface region 373. An adjacent or upper foam strip 375 having an outer surface 376 and an inner surface 377 has a lower surface 378. The lower surface of the strip 375 has a land portion 379, whereas the lower strip 370 has a land portion 374. The land portion 379 of the upper strip is in engagement with and sealed or joined to the upper surface 373 of the lower strip 370 at a location generally adjacent the outer surface of the strips 370 and 375. A space or unsealed region 381 is defined between the strips 370 and 375 in a region generally adjacent the inner surfaces 372 and 377.

Thus, the inner surfaces 377 and 372 when cooled to cryogenic temperatures tend to contract and the forces set up at the sealed or joined portion of the foam occur in such a manner that cracks tend to propagate in directions more or less parallel to the surfaces 371, 376, 372 and 377, rather than perpendicular thereto. Beneficially, suitable shaped preform strips having lands formed in the appropriate position may be formed by any desired foam shaping technique, including hot wire cutting, sawing, milling or the like.

In FIG. 20 there is schematically depicted a fractional view of one embodiment of the invention generally designated by the reference numeral 390. The embodiment 390 comprises a wall 391 having an externally or insulated face 392, a first body of porous fibrous insulation 393 disposed on the face 392 of the wall 391. A second fibrous insulating body 394 is disposed upon the face in spaced relationship to the body 393. The bodies 393 and 394 define a space 395 therebetween. A first strip 397 of synthetic resinous thermoplastic material is disposed generally adjacent the insulating layer 393 and remote from the surface 392. A second strip 398 is disposed adjacent the strip 397. The strips 398 and 397 are joined by an internal seal or heat weld 399. The heat weld 399 is disposed generally adjacent an outer face 401 of the insulation made up of the strips 397 and 398 and remote from the face 392 of the wall 391. Remote from the outer face 401, the insulation and adjacent face 392, a stress relief slot 402 is defined between the insulating strips 397 and 398. Remote from the fibrous insulation 393 and 394, the slot 402 terminates in a generally bulbous cavity 404. Fibrous reinforcing members 406 are shown embedded within the insulating members 397 and 398. A metallic vapor barrier member 408 is shown disposed on the surface 401 of the insulating members 397 and 398.

The embodiment as depicted in FIG. 20 is particularly suitable for cryogenic vessels which operate at relatively low temperatures. The space 395 defined between the fibrous insulating elements 393 and 394 provides an adequate path for venting gaseous material which might escape through the wall 391, and the slot 402 having the bulbous termination 404 provides substantial stress relief under the influence of substantial thermogradient which is employed when the temperature of the wall 391 is lowered substantially below ambient temperature.

In FIG. 21 there is schematically epicted a section of an insulated vessel generally designated by the reference numeral 410 which comprises a vessel wall 411 having an exterior or insulated surface 412. A compressible fibrous batt 413 is disposed adjacent the surface 412. Beneficially, the fibrous batt may be of glass, inorganic or organic fibers. The batt 413 has an exterior surface 414 generally remote from the wall 411. A reinforcing fabric or scrim 415 is disposed generally in contact with the surface 414. A foam-in-place foam insulation 417 is disposed adjacent the scrim 415 and comprises a first or lower strip 418 and a second or upper strip 419, the strips 418 and 419 representing strips of foam-in-place material deposited from a foam depositing means such as that depicted in FIGS. 17 and 18. A second reinforcing scrim 421 is generally centrally disposed within the insulation 417 and lies generally parallel to the first scrim 415. A non-adhering film strip 423 is disposed between the first scrim 415 and the second scrim 421 at a locaton representing the juncture of the strips 418 and 419. A third or external scrim 424 is disposed generally parallel to the first scrim 415 on an outer face 426 of the cellular insulation 417. A fourth or lateral scrim 427 extends from the first scrim 415 to the third scrim 424 and is incorporated within the foaming material as it is depicted, such as by the apparatus depicted in FIGS. 17 and 18. A strand or roving reinforcement 429 is disposed within the insulation 417 at desired locations.

Figure 22:
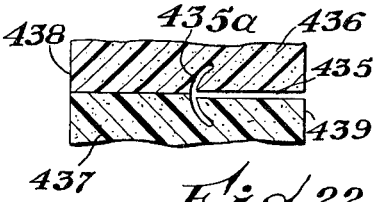

FIG. 22 depicts one form of a stress relief slot generally designated by the reference numeral 435. The slot 435 is defined between the first insulating strip 436 and the second insulating strip 437. The strips 436 and 437 define an external surface 438 and an internal surface 439. The slot 435 extends inwardly from the surface 439 toward the surface 438 and terminates generally midway between the surfaces 438 and 439 in a generally arcuate, inwardly concave termination 435*a*.

The embodiment depicted in FIG. 22 is particularly beneficial in cases where extreme temperature cycling may be desired and it is desired that any crack propagation be toward the inner surface 439 rather than parallel to the surface 439 or the outer surface 438.

FIG. 23 depicts an alternate form of joint, generally designated by the reference numeral 440, between adjacent thermoplastic strips 441 and 442. A fabric reinforcement 443 in the form of a folded strip having terminal edges 444 and 445 is adjacent the outer surface 446 of the joint 440. The strip 443 defines an internal bead 448. The internal bead 448 is disposed within a slot 449 and has a configuration generally similar to the slot 402 of FIG. 20. Beneficially, the fabric reinforcement 443 and its bulbous termination 448 substantially reduce the tendency of any cracks to propagate toward the outer surface 446.

FIG. 24 depicts an arrangement generally similar to that of FIG. 23 and a joint arrangement 450 generally similar to the arrangement 440 of FIG. 23. The joint 450 of FIG. 24 differs from that of FIG. 23 in that a fibrous reinforcing 451 comprises a first strip 452 and a second strip 453 extending from the outer surface 454 inwardly through a slot 455 of generally similar configuration to the slot 402 of FIG. 20. The reinforcing elements 452 and 453 within a bulbous termination 456 are adhered to opposed inner surfaces of the termination 456 and provide effective resistance to crack initiation on the reinforced surface.

In FIG. 25 there is schematically depicted a manner of joining a prefoamed formed cap 460 to insulation 461 which has been spirally generated upon a tank 463. A ring 464 is affixed to the tank 463 by means of a plurality of pins 465. The ring 464 in turn is pinned to a flanged ring 466 having a generally diametrically disposed flange 467 and a generaly perpendicular flange 468. A combination of the rings 464 and 466 firmly terminate the insulation foamed in place. The cap 460 is terminated by a protective angular ring 470 generally oppositely disposed to the ring 470. Beneficially, the rings 466 and 470 are prepared from materials of minimal thermal conductivity such as glass fiber reinforced plastics; e.g., polyesters and epoxy resins. The rings 466 and 470 are joined by a band 472 which advantageously is prepared in place by saturation of glass fibers with suitable hardening resins such as epoxy resins. The joint in turn is then covered with an annular layer of foam plastic insulation designated by the reference numeral 474 which beneficially may be generated in the same manner as the foamed-in-place foam plastic insulation 461.

In FIG. 26 there is depicted an alternate tank or container insulating layer generally designated by the reference numeral 480. The insulating layer 480 comprises a plurality of loops or turns of foamed synthetic resinous material designated by the reference numerals 481, 481*a* and 481*b*. Each of the turns or loops 481 is of generally rectangular elongate configuration and has defined therein a pair of longitudinal slots 482 and 483 which extend lengthwise in the insulation loop and extend from a face 484 adapted to be disposed adjacent the surface to be insulated to a location on an opposite or remote face 485. The slots 482 and 483 are disposed a distance of up to one quarter the total distance between the strips 481 and 481*b* and extend generally parallel to the interface therebetween. The strip 481 also defines a plurality of transversely extending slots or slits 486 which are disposed substantially normal to the slots 482 and 483 and extend the entire thickness or height of the strip 481. The strip 481 is bonded to the strips 481*a* and 481*b* as hereinbefore described. Beneficially, a filamentary reinforcing or scrim 487 is disposed on the face 485. The scrim 487 overlays the edges of the strip 481, the face 485 of the strip 481 and extends between the strips 481 and 481*a* and also 481 and 481*b* at locations adjacent to the face 485 and remote from the face 484. Adjacent portions of scrim are adhered together without directly bonding the strips 481, 481*a*, etc. together, thereby providing an additional slot between strips. As a series of strips such as the strips 481, 481*a* and 481*b* are deposited, the reinforcing scrims reinforce the joint between adjacent strips as well as the external surface thereof and provide a mode of crack termination which is particularly strong at the location of the joints between adjacent strips or loops. An insulation layer 488 is disposed over the scrim 487. Beneficially the insulation layer 488 may also be of synthetic resinous foam and adhered to the scrim. A protective or metallic layer 489 is disposed on the insulation layer 488 remote from the face 485. Both the layers 488 and 489 are simultaneously deposited with the strip 481 and welded, adhered or bonded to the previously deposited material.

The embodiment of the invention as depicted in FIG. 26 is particularly advantageous wherein extreme temperature variations are encountered between the inner face of the insulation adjacent a container and the exterior face, such as the face or protective layer 489. By the provision of the slots such as the slots 482, 483 and 486 and similar slots in adjacent turns, cracking of the insulation because of thermal shrinkage is controlled in a predetermined manner and is confined to areas other than the joints between the adjacent turns of insulation.

Although as schematically depicted in FIG. 26 the slots are shown to have finite width, generally it is beneficial in preparing the foam to provide slots of relatively narrow width. Kerf-less sawing or slitting of synthetic resinous foams is well known to those skilled in the art. Although the pattern of the slits is depicted as being generally square, other patterns are readily employed such as the patterns depicted in U.S. Pat. Nos. 3,042,562 and 3,106,983, the teachings of which are herewith incorporated by reference.

An alternate embodiment of insulation in accordance with the present invention is schematically set forth in FIG. 27 and is designated by the reference numeral 490. The insulation 490 is generally similar to that depicted in FIG. 26 and comprises a plurality of insulating strips 491, 491*a* and 491*b* adhered to each other. The strip 491 defines first and second slits 492 and 493 which extend generally longitudinally therein and are equivalent to slits 482 and 483 of FIG. 26. The strip 491 has a first face 494 and a second face 495. The slits extend from the face 494 to a location adjacent the face 495. The face 494 and equivalent faces on the strips 491*a* and 491*b* have disposed thereon a reinforcing scrim or fabric 496. Optionally, and frequently with benefit, the scrim 496 is severed at locations corresponding to the junction of the slits 492 and 493 in the surface 494. A reinforcing scrim 497 similar to the scrim 487 is disposed on the surface 495 remote from the surface 494. The scrim 497 beneficially overlaps the strip 491*b* and extends into the joint between the strips 491 and 491*a* as hereinbefore described. Over the scrim 497 and equivalent scrims is disposed the insulating layer 498 such as an integral skinned polystyrene foam board and a protective layer 499 remote from the surface 495. Disposed within the joints between the adjacent strips 491, 491*a* and 491*b* are a plurality of reinforcing tapes 501. The tapes 501 beneficially are applied to the strips prior to deposition, and beneficially at a location generally equivalent to the insulation source 78 the strips desirably comprise a plurality of elongate filaments in a synthetic resinous thermoplastic matrix which are heat sealed or otherwise joined to the bottom of the strip prior to forwarding to the deposition head. For example: when the strip such as the strip 491 is of polystyrene foam, beneficially the reinforcement strips 501 can contain filaments such as wire or glass which have previously been coated with polystyrene and are heat sealed to the bottom of the strip to provide reinforcement both during the forwarding of the strip to the deposition head and in the finished insulating structure. The embodiment of FIG. 27 provides controlled cracking in the generally equatorial plane and restrains cracking in a meridional direction by means of the reinforcing scrims 496.

Employing the present invention, insulation is readily provided in a variety of manners on a curved surface. A rigid insulation such as a plastic foam may be installed generally in contact with the wall of the vessel, or alternately, it can be spaced therefrom with or without a loose fibrous batt. If it is desired to use thermosetting foams rather than thermoplastic foams, suitable adhesive such as epoxy resins are readily substituted for heat sealing to join the insulation into a unitary body. The insulation may be provided with a skin; that is, a reinforcement such as a fabric scrim, on the inner surface and/or the outer surface. Similarly, scrim may be disposed in the joint between adjacent turns of the insulation material with or without preformed slots or regions of low adhesion to control stress cracking. Suitable reinforcing elements may be disposed in any desired location either by heat or adhesive bonding or by inclusion in a foamable hardenable composition. Thus, almost any desired characteristics can be introduced into the insulating layer.

If desired, cylindrical vessels are readily insulated in accordance with the present invention by employing an appropriate arrangement of guide rails; for example, a guide rail at the top of the vessel and the bottom of the vessel with a suitable straight support carried thereby. For case of illustration, controls and control circuitry have been omitted. For most applications, simple limit switches are adequate to maintain the desired positioning of the foam depositing hed or the vapor barrier depositing means.

In certain instances when employing preformed foam strips, it may be desirable to modify the welding apparatus such as that depicted in FIG. 8 to provide for vertical movement of a welding platen, such as the welding platen 215, to provide a joint having the general configuration of the joint of FIG. 19 which can provide greater flexibility as the diameter of the loops decrease, plus a stress relief space extending generally vertically at the joint.

Thus, depending upon the requirements of the particular insulation on a vessel the insulation may be applied from the bottom up, from the top down or in any convenient or desirable manner with almost any desired configuration of foam insulation with or without reinforcing and stress relief.

As is apparent from the foregoing specification, the present invention is susceptible of being embodied with various alterations and modifications which may differ particularly from those that have been described in the preceding specification and description. For this reason, it is to be fully understood that all of the foregoing is intended to be merely illustrative and is not to be construed or interpreted as being restrictive or otherwise limiting of the present invention.

What is claimed is:

1. A method for the insulation of a vessel having at least one curved wall, the steps of the method comprising depositing a plastic foam strip and a vapor barrier material in the form of a strip about the periphery of the vessel in a plurality of loops, with the further limitation that the vapor barrier material is disposed remote from the vessel wall and the foam strip adjacent the vessel wall, joining together adjacent loops of foam strip at a location remote from the vessel to thereby envelop at least a portion of the vessel within an insulating enclosure, the adjacent loops of foam strip being generally unconnected adjacent the vessel, and joining adjacent edges of the strip of vapor barrier material together.

2. A method for the insulation of a generally spherical vessel, the steps of the method comprising depositing a plastic foam strip and a vapor barrier material in the form of a strip about the periphery of the vessel in a plurality of loops, with the further limitation that the vapor barrier material is disposed remote from the vessel wall and the foam strip adjacent the vessel wall, joining together adjacent loops of foam strip at a location remote from the vessel to thereby envelop at least a portion of the vessel within an insulating enclosure, the adjacent loops of foam strip being generally unconnected adjacent the vessel, and joining adjacent edges of the strip of vapor barrier material together.

3. A method for the insulation of a generally spherical vessel, the steps of the method comprising depositing a plastic foam strip and a metal vapor barrier material in the form of a strip about the periphery of the vessel in a plurality of loops, with the further limitation that the vapor barrier material is disposed remote from the vessel wall and the foam strip adjacent the vessel wall, joining together adjacent loops of foam strip at a location remote from the vessel to thereby envelop at least a portion of the vessel within an insulating enclosure, the adjacent loops of foam strip being generally unconnected adjacent the vessel, joining adjacent edges of the strip of vapor barrier material together.

4. The method of claim 3 including the step of forming the plastic foam strip from a plurality of shorter foam strips by joining the shorter foam strip in end to end relationship.

5. The method of claim 4 including the step of corrugating the barrier material.

6. The method of claim 5 wherein the insulating material is a preformed foam plastic strip.

7. The method of claim 6 wherein the preformed plastic strip is polystyrene foam.

8. The method of claim 3 wherein the plastic foam is a thermosetting foam.

9. The method of claim 3 including the step of including within the foam at least one generally filamentary reinforcing element.

10. The method of claim 9 including the step of forming a region of low adhesion between adjacent loops generally adjacent the vessel.

11. The method of claim 10 werein the region of low adhesion is formed by inclusion of a slip sheet adjacent the vessel and between adjacent loops of insulation.

12. The method of claim 3 wherein the insulating material is a foam-in-place composition.

13. A method for the insulation of a vessel having at least one curved wall, the steps of the method comprising depositing a preformed plastic foam strip and a vapor barrier material in the form of a strip about the periphery of the vessel in a plurality of loops, with the further limitation that the vapor barrier material is disposed remote from the vessel wall and the foam strip adjacent the vessel wall, joining together adjacent loops of foam strip at a location remote from the vessel to thereby envelop at least a portion of the vessel within an insulating enclosure, the adjacent loops of foam strip being generally unconnected adjacent the vessel, and heat sealing adjacent edges of the strip of vapor barrier material together.

14. A method for the insulation of a generally spherical vessel, the steps of the method comprising depositing a preformed plastic foam strip and a vapor barrier material in the form of a strip about the periphery of the vessel in a plurality of loops, with the further limitation that the vapor barrier material is disposed remote from the vessel wall and the foam strip adjacent the vessel wall, joining together adjacent loops of foam strip at a location remote from the vessel to thereby envelop at least a portion of the vessel within an insulating enclosure, the adjacent loops of foam strip being generally unconnected adjacent the vessel, and heat sealing adjacent edges of the strip of vapor barrier material together.

15. A method for the insulation of a generally spherical vessel, the steps of the method comprising depositing a plastic foam strip and a metal vapor barrier material in the form of a strip about the periphery of the vessel in a plurality of loops, with the further limitation that the vapor barrier material is disposed remote from the vessel wall and the foam strip adjacent the vessel wall, joining together adjacent loops of foam strip at a location remote from the vessel to thereby envelop at least a portion of the vessel within an insulating enclosure, the adjacent loops of foam strip being generally unconnected adjacent the vessel, heat sealing adjacent edges of the strip of vapor barrier material together.

16. The method of claim 15 including the step of forming the plastic foam strip from a plurality of shorter foam strips by joining the shorter foam strip in end to end relationship.

17. The method of claim 16 including the step of corrugating the barrier material.

18. The method of claim 17 wherein the insulating material is a preformed foam plastic strip.

19. The method of claim 18 wherein the preformed plastic strip is polystyrene foam.

20. The method of claim 15 wherein the plastic foam is a thermosetting foam.

21. The method of claim 15 including the step of including within the foam at least one generally filamentary reinforcing element.

22. The method of claim 21 including the step of forming a region of low adhesion between adjacent loops generally adjacent the vessel.

23. The method of claim 22 wherein the region of low adhesion is formed by inclusion of a slip sheet adjacent the vessel and between adjacent loops of insulation.

24. The method of claim 15 wherein the insulating material is a foam-in-place composition.

* * * * *

UNITED STATES PATENT AND TRADEMARK OFFICE

CERTIFICATE OF CORRECTION

PATENT NO. : 4,017,346

DATED : April 12, 1977

INVENTOR(S) : Hubert Stacy Smith

It is certified that error appears in the above-identified patent and that said Letters Patent are hereby corrected as shown below:

Column 1, between lines 2 and 3: The heading --Cross-Reference to Related Applications-- should be inserted.

Column 2, line 48: The word "surfaces" should read --surface--.

Column 3, line 43: "Fig. 23, 23" should read --Figs. 22, 23--.

Column 3, line 45: The word "stips" should read --strips--.

Column 4, line 3: The words "adapted to enclosure 53" should be deleted.

Column 6, line 21: The comma after "carries" should be deleted.

Column 7, line 17: The word "form" should read --foam--.

Column 8, line 27: The word "of" should read --or--.

Column 10, line 9: The word "installation" should read --insulation--.

Column 12, line 39: "326 and 3" should read --2 and 3--.

Column 12, line 42: "236" should read --326--.

Column 14, line 44: The word "epicted" should read --depicted--

UNITED STATES PATENT AND TRADEMARK OFFICE

CERTIFICATE OF CORRECTION

PATENT NO. : 4,017,346

DATED : April 12, 1977

INVENTOR(S) : Hubert Stacy Smith

It is certified that error appears in the above–identified patent and that said Letters Patent are hereby corrected as shown below:

Column 14, line 63: The word "locaton" should read --location--.

Column 15, line 49: The word "generaly" should read --generally--.

Column 17, line 62: The word "case" should read --ease--.

Column 17, line 65: The word "hed" should read --head--.

Signed and Sealed this

*Twenty-eighth* Day of *March 1978*

[SEAL]

*Attest:*

RUTH C. MASON
*Attesting Officer*

LUTRELLE F. PARKER
*Acting Commissioner of Patents and Trademarks*